US009530353B2

(12) United States Patent
Kim et al.

(10) Patent No.: US 9,530,353 B2
(45) Date of Patent: Dec. 27, 2016

(54) ORGANIC ELECTROLUMINESCENT DISPLAY DEVICE AND METHOD OF DRIVING THE SAME

(71) Applicant: LG Display Co., Ltd., Seoul (KR)

(72) Inventors: Seung-Tae Kim, Gyeyang-gu (KR); Han-Jin Bae, Uiwang-si (KR); Ho-Min Lim, Yongsin-si (KR); Won-Kyu Ha, Gumi-si (KR); Hak-Su Kim, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/012,768

(22) Filed: Aug. 28, 2013

(65) Prior Publication Data

US 2014/0055327 A1 Feb. 27, 2014

Related U.S. Application Data

(62) Division of application No. 12/453,617, filed on May 15, 2009, now Pat. No. 8,547,305.

(30) Foreign Application Priority Data

Nov. 15, 2008 (KR) ..... 10 2008 0113712

(51) Int. Cl.
*G09G 3/30* (2006.01)
*G09G 3/32* (2016.01)

(52) U.S. Cl.
CPC ..... *G09G 3/3258* (2013.01); *G09G 3/3233* (2013.01); *G09G 2300/0819* (2013.01); *G09G 2300/0852* (2013.01); *G09G 2300/0866* (2013.01); *G09G 2300/0876* (2013.01); *G09G 2310/0251* (2013.01); *G09G 2310/0262* (2013.01); *G09G 2320/043* (2013.01)

(58) Field of Classification Search
CPC ..... G09G 3/12; G09G 3/14; G09G 3/30; G09G 3/32; G09G 3/3208; G09G 3/3225; G09G 3/3233; G09G 3/3241; G09G 3/325; G09G 3/3258; G09G 3/10; G09G 3/36; G09G 3/3283; G09G 3/3291; G09G 5/00; G09G 3/00
USPC ..... 345/76–82
See application file for complete search history.

(56) References Cited

U.S. PATENT DOCUMENTS 8,054,250 B2 11/2011 Kim
2002/0195968 A1* 12/2002 Sanford et al. ..... 315/169.3
(Continued)

*Primary Examiner* — Ilana Spar
*Assistant Examiner* — Nguyen H Truong
(74) *Attorney, Agent, or Firm* — Dentons US LLP

(57) ABSTRACT

An organic electroluminescent display device includes an organic electroluminescent diode receiving a driving voltage and a first ground voltage; first and second driving thin film transistors for providing a driving current to the organic electroluminescent diode; a first switching thin film transistor receiving a data voltage and switched by an nth scan signal; a second switching thin film transistor switched by a current providing signal; a third switching thin film transistor receiving a second ground voltage and switched by a selection signal; a fourth switching thin film transistor disposed among an output terminal of the second switching thin film transistor; and a first capacitor disposed among the output terminal of the first switching thin film transistor, the gate terminal of the first driving thin film transistor and the gate terminal of the second driving thin film transistor.

7 Claims, 10 Drawing Sheets

(56) References Cited

U.S. PATENT DOCUMENTS

| | | | | |
|---|---|---|---|---|
| 2003/0043131 | A1 | 3/2003 | Iguchi | |
| 2004/0246209 | A1 | 12/2004 | Sung | |
| 2004/0252089 | A1 | 12/2004 | Ono et al. | |
| 2005/0017934 | A1 | 1/2005 | Chung et al. | |
| 2005/0237273 | A1 | 10/2005 | Ozawa et al. | |
| 2006/0061293 | A1* | 3/2006 | Kobayashi et al. | 315/169.3 |
| 2006/0231740 | A1* | 10/2006 | Kasai | 250/214.1 |
| 2008/0150846 | A1* | 6/2008 | Chung | 345/80 |
| 2008/0211746 | A1* | 9/2008 | Caligiore et al. | 345/76 |
| 2008/0211747 | A1* | 9/2008 | Kim | 345/76 |
| 2008/0231566 | A1* | 9/2008 | Naugler | 345/82 |

* cited by examiner

ORGANIC ELECTROLUMINESCENT DISPLAY DEVICE AND METHOD OF DRIVING THE SAME

This application is a divisional application of U.S. application Ser. No. 12/453,617, filed May 15, 2009, which claims the benefit of Korean Patent Application No. 10-2008-0113712, filed on Nov. 15, 2008, each of which are hereby incorporated by reference for all purposes as if fully set forth herein.

BACKGROUND OF THE INVENTION

Field of the Invention

The present invention relates to an organic electroluminescent display (OELD) device, and more particularly, to an OELD device being capable of displaying an image of uniform brightness and a method of driving the OELD.

Background for the Related Art

The liquid crystal display (LCD) device requires a light source therein because it is non-emission type display device. The OELD device is introduced to overcome this disadvantage of an active matrix type liquid crystal display device. In the OELD device, an organic luminescent layer is exited to emit light. The OELD device is driven by a relatively low voltage and has a thin profile.

FIG. 1 is a circuit diagram showing a pixel of an active matrix type OELD device according to the related art. As shown in FIG. 1, two transistors and one capacitor are disposed in the pixel. The OELD device includes a scanning line "S", a data line "D", a switching thin film transistor (TFT) "SW", a capacitor "C", a driving TFT "DR" and an organic electroluminescent diode "E" on a substrate. For example, each of the switching and driving TFTs "SW" and "DR" may be an NMOS type TFT.

A gate of the switching TFT "SW" is connected to the scanning line, and a source of the switching TFT "SW" is connected to the data line "D". One end of the capacitor "C" is connected to a drain of the switching TFT "SW", and a ground voltage "VSS" is applied to the other end of the capacitor "C".

A source of the driving TFT "DR" is connected to a power line. A driving voltage "VDD" is applied to the drain of the driving TFT "DR" through the power line. A drain of the driving TFT "DR" is connected to an electrode of the organic electroluminescent diode "E". A gate of the driving TFT "DR" is connected to the drain of the switching TFT "SW".

A driving principle of the device shown in FIG. 1 is explained with FIG. 2. FIG. 2 is a timing chart of signals in an OELD device according to the related art. When an nth scan signal "S(n)" of a high voltage "Vgh" is applied to the switching TFT "SW" through the scanning line S, the switching TFT "SW" is turned on. The scan signal "S(n)" is generated from a gate driving integrated circuit (IC) (not shown). The high scan signal "Vgh" is a positive voltage. The scan signal "S(n)" is pulsed from a low voltage "Vgl" to the high voltage "Vgh".

When the switching TFT "SW" is turned on, a data voltage "Vdata" is applied to the capacitor "C" through the data line "D" and the switching TFT "SW" such that an electric charge is charged in the capacitor "C". Since a channel of the driving TFT "DR" is an NMOS type, the data voltage is positive. Amount of an electric current passes through the channel of the driving TFT "DR" depends upon a potential difference between a charged voltage of the capacitor "C" and the driving voltage "VDD". Brightness of light from the organic electroluminescent diode "E" is determined by the amount of an electric current passing through the channel of the driving TFT "DR".

Unfortunately, the driving TFT "DR" in each pixel has a deviation in an electric property such that each pixel has different brightness in the same condition. In a panel using a low temperature poly-silicon type backplane, there is a deviation of an electric property in the driving TFTs "DR" because of an excimer laser annealing process for the low temperature poly-silicon. Accordingly, even if the same voltage is applied to the driving TFT "DR" in each pixel, there are differences in amounts of an electric current passing through the channel of the driving TFT "DR" such that brightness uniformity of images on the OELD device is deteriorated.

On the other hand, in a panel using an amorphous silicon type backplane, there is thermal degradation in the driving TFTs "DR" when the driving TFTs "DR" are driven. Each driving TFT "DR" in the pixels has a difference in the thermal degradation such that brightness uniformity of images on the OELD device is deteriorated.

Referring to FIG. 3, which is a graph showing deviation of an electric current on an organic electroluminescent diode with respect to a voltage on a driving TFT in the related art OELD, an electric current on the organic electroluminescent diode "E" (of FIG. 1) in one pixel is different from that in another pixel because of deviation in an electric property of the driving TFT "DR" (in FIG. 1). As a result, even if each pixel is driven under the same condition, each pixel displays an image having a difference in brightness such that brightness uniformity is deteriorated. For example, afterimages or a stain is generated on the image panel.

SUMMARY OF THE INVENTION

Accordingly, the present invention is directed to an organic electroluminescent display (OELD) device and a method of driving the same that substantially obviate one or more of the problems due to limitations and disadvantages of the related art.

An object of the present invention is to provide an OELD device including driving TFTs having an uniform electric property and being capable of displaying an image having uniform brightness.

Another object of the present invention is to provide a method of driving an OELD device being capable of minimizing deviation in an electric property of driving TFTs.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an organic electroluminescent display device includes an organic electroluminescent diode receiving a driving voltage and a first ground voltage; first and second driving thin film transistors for providing a driving current to the organic electroluminescent diode, each of the first and second driving thin film transistors receiving one of the driving voltage and the first ground voltage; a first switching thin film transistor receiving a data voltage and switched by an nth scan signal to output the data voltage; a second switching thin film transistor switched by a current providing signal to provide the one of the driving voltage and the first ground voltage to the second driving thin film transistor; a third switching thin film transistor receiving a second ground voltage and switched by a selection signal to output the second ground voltage to an output terminal of the first switching thin film transistor; a fourth switching thin film transistor disposed among an output terminal of the second switching thin film transistor, a gate terminal of the first driving thin film transistor and a gate terminal of the second driving thin film transistor and switched by the selection signal; and a first capacitor disposed among the output terminal of the first switching thin film transistor, the gate terminal of the first driving thin film transistor and the gate terminal of the second driving thin film transistor, wherein "n" is a positive integer.

In another aspect, a method of driving an organic electroluminescent display device including an organic electroluminescent diode receiving a driving voltage and a first ground voltage, first and second driving thin film transistors for providing a driving current to the organic electroluminescent diode, each of the first and second driving thin film transistors receiving one of the driving voltage and the first ground voltage, a first switching thin film transistor receiving a data voltage and switched by an nth scan signal to output the data voltage, a second switching thin film transistor switched by a current providing signal to provide the one of the driving voltage and the first ground voltage to the second driving thin film transistor, a third switching thin film transistor receiving a second ground voltage and switched by a selection signal to output the second ground voltage to an output terminal of the first switching thin film transistor, a fourth switching thin film transistor disposed among an output terminal of the second switching thin film transistor, a gate terminal of the first driving thin film transistor and a gate terminal of the second driving thin film transistor and switched by the selection signal, a first capacitor disposed among the output terminal of the first switching thin film transistor, the gate terminal of the first driving thin film transistor and the gate terminal of the second driving thin film transistor and a second capacitor disposed between a source terminal of the second driving thin film transistor and the gate terminal of the second driving thin film transistor, wherein "n" is a positive integer, includes switching the first switching thin film transistor to be turned off and the second to fourth switching thin film transistors to be turned on such that the one of the driving voltage and the first ground voltage is provided into the first and second capacitors; switching the third and fourth switching thin film transistors to be turned on and the second switching thin film transistor to be turned off such that wherein a threshold voltage of the second driving thin film transistor is charged in each of the first and second capacitors; switching the first switching thin film transistor to be turned on and providing the data voltage into the second capacitor through the first switching thin film transistor, wherein the third and fourth switching thin film transistors are switched to be turned off; and switching the second switching thin film transistor to be turned on and the first switching thin film transistor to be turned off such that the organic electroluminescent diode emits a light using the driving voltage and the first ground voltage.

In another aspect, a method of driving an organic electroluminescent display device including an organic electroluminescent diode receiving a driving voltage and a first ground voltage, first and second driving thin film transistors for providing a driving current to the organic electroluminescent diode, each of the first and second driving thin film transistors receiving one of the driving voltage and the first ground voltage, a first switching thin film transistor receiving a data voltage and switched by an nth scan signal to output the data voltage, a second switching thin film transistor switched by a current providing signal to provide the one of the driving voltage and the first ground voltage to the second driving thin film transistor, a third switching thin film transistor receiving a second ground voltage and switched by a selection signal to output the second ground voltage to an output terminal of the first switching thin film transistor, a fourth switching thin film transistor disposed among an output terminal of the second switching thin film transistor, a gate terminal of the first driving thin film transistor and a gate terminal of the second driving thin film transistor and switched by the selection signal, a first capacitor disposed among the output terminal of the first switching thin film transistor, the gate terminal of the first driving thin film transistor and the gate terminal of the second driving thin film transistor and a second capacitor disposed between a source terminal of the third switching thin film transistor and the gate terminal of the third switching thin film transistor, wherein "n" is a positive integer, includes switching the first switching thin film transistor to be turned off and the second to fourth switching thin film transistors to be turned on such that the one of the driving voltage and the first ground voltage is provided into the first and second capacitors; switching the third and fourth switching thin film transistors to be turned on and the second switching thin film transistor to be turned off such that wherein a threshold voltage of the second driving thin film transistor is charged in the first capacitor; switching the first switching thin film transistor to be turned on and providing the data voltage into the second capacitor through the first switching thin film transistor, wherein the third and fourth switching thin film transistors are switched to be turned off; and switching the second switching thin film transistor to be turned on and the first switching thin film transistor to be turned off such that the organic electroluminescent diode emits a light using the driving voltage and the first ground voltage.

In another aspect, a method of driving an organic electroluminescent display device including an organic electroluminescent diode receiving a driving voltage and a first ground voltage, first and second driving thin film transistors for providing a driving current to the organic electroluminescent diode, each of the first and second driving thin film transistors receiving one of the driving voltage and the first ground voltage, a first switching thin film transistor receiving a data voltage and switched by an nth scan signal to output the data voltage, a second switching thin film transistor switched by a current providing signal to provide the one of the driving voltage and the first ground voltage to the second driving thin film transistor, a third switching thin film transistor receiving a second ground voltage and switched by a selection signal to output the second ground voltage to an output terminal of the first switching thin film transistor, a fourth switching thin film transistor disposed among an output terminal of the second switching thin film transistor, a gate terminal of the first driving thin film transistor and a gate terminal of the second driving thin film transistor and switched by the selection signal, a fifth switching thin film transistor receiving an initial voltage and switched by an initializing signal to output the initial voltage into the gate terminal of the first driving thin film transistor and the gate terminal of the second driving thin film transistor, a first capacitor disposed among the output terminal of the first switching thin film transistor, the gate terminal of the first driving thin film transistor and the gate terminal of the second driving thin film transistor, and a second capacitor disposed between a source terminal of the third switching thin film transistor and the gate terminal of the third switching thin film transistor, wherein "n" is a positive integer, includes switching the fifth switching thin film transistor to be turned on such that the initial voltage of a low level is provided into the gate terminal of the first and second driving thin film transistors; providing the initial voltage of a high level into the gate terminal of the first and second driving thin film transistors with the fifth switching thin film transistor to be turned on; switching the third and fourth switching thin film transistor to be turned on and the first and second switching thin film transistors to be turned off such that a threshold voltage of the second driving thin film transistor is charged in each of the first and second capacitors; switching the first switching thin film transistor to be turned on and providing the data voltage into the second capacitor through the first switching thin film transistor, wherein the third and fourth switching thin film transistors are switched to be turned off; and switching the second switching thin film transistor to be turned on and the first switching thin film transistor to be turned off such that the organic electroluminescent diode emits a light using the driving voltage and the first ground voltage.

In another aspect, a method of driving an organic electroluminescent display device including an organic electroluminescent diode receiving a driving voltage and a first ground voltage, first and second driving thin film transistors for providing a driving current to the organic electroluminescent diode, each of the first and second driving thin film transistors receiving one of the driving voltage and the first ground voltage, a first switching thin film transistor receiving a data voltage and switched by an nth scan signal to output the data voltage, a second switching thin film transistor switched by a current providing signal to provide the one of the driving voltage and the first ground voltage to the second driving thin film transistor, a third switching thin film transistor receiving a second ground voltage and switched by a selection signal to output the second ground voltage to an output terminal of the first switching thin film transistor, a fourth switching thin film transistor disposed among an output terminal of the second switching thin film transistor, a gate terminal of the first driving thin film transistor and a gate terminal of the second driving thin film transistor and switched by the selection signal, a fifth switching thin film transistor receiving an initial voltage and switched by an initializing signal to output the initial voltage into the gate terminal of the first driving thin film transistor and the gate terminal of the second driving thin film transistor, a first capacitor disposed among the output terminal of the first switching thin film transistor, the gate terminal of the first driving thin film transistor and the gate terminal of the second driving thin film transistor, and a second capacitor disposed between a source terminal of the third switching thin film transistor and the gate terminal of the third switching thin film transistor, wherein "n" is a positive integer, includes switching the fifth switching thin film transistor to be turned on such that the initial voltage of a low level is provided into the gate terminal of the first and second driving thin film transistors; switching the second to fourth switching thin film transistors to be turned on and the first and fifth switching thin film transistors to be turned off such that the driving voltage is provided into the first and second capacitors; switching the third and fourth switching thin film transistors to be turned on and the first, second and fifth switching thin film transistors to be turned off such that a threshold voltage of the second driving thin film transistor is charged in each of the first and second capacitors; switching the first switching thin film transistor to be turned on and providing the data voltage into the second capacitor through the first switching thin film transistor, wherein the third and fourth switching thin film transistors are switched to be turned off; and switching the second switching thin film transistor to be turned on and the first switching thin film transistor to be turned off such that the organic electroluminescent diode emits a light using the driving voltage and the first ground voltage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Reference will now be made in detail to embodiments of the present invention, examples of which are illustrated in the accompanying drawings.

In the related art OELD device, a driving electric current (Ie) of the organic electroluminescent diode is evaluated by following equation 1.

$$Ie=(1/2)*\mu*Cox*(W/L)*(Vgs-Vth)^2, \quad [1]$$

wherein η is a mobility, Cox is capacitance, (W/L) is a ratio of a width of the channel of the driving TFT to a length of the channel of the driving TFT, Vgs is a voltage difference between the gate terminal and the source terminal of the driving TFT, and Vth is a threshold voltage of the driving TFT.

In the above equation, the threshold voltage (Vth) has a strongly effect on the driving electric current (Ie) because of a square dimension. Accordingly, the present invention intends to remove an effect of the threshold voltage (Vth) on the driving electric current (Ie) to minimize deviation in the electric property of the driving TFT.

Figure 1:
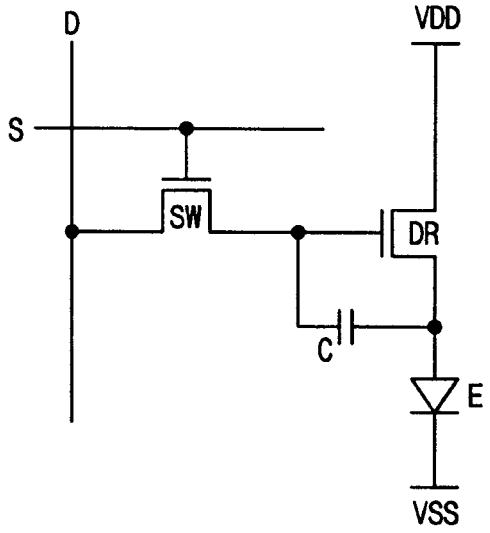
FIG. 1 RELATED ART
FIG. 1 is a circuit diagram showing a pixel of an active matrix type OELD device according to the related art.
Figure 2:
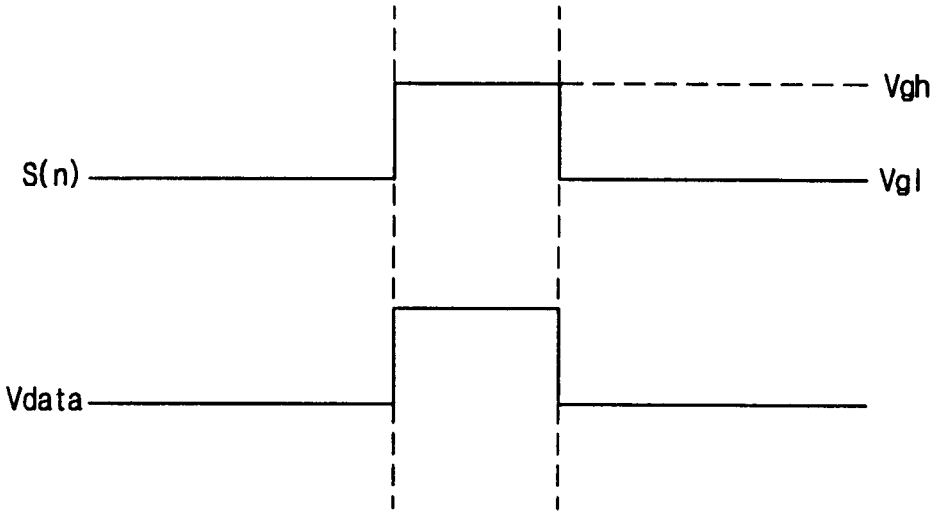
FIG. 2 RELATED ART
FIG. 2 is a timing chart of signals in an OELD device according to the related art.
Figure 3:
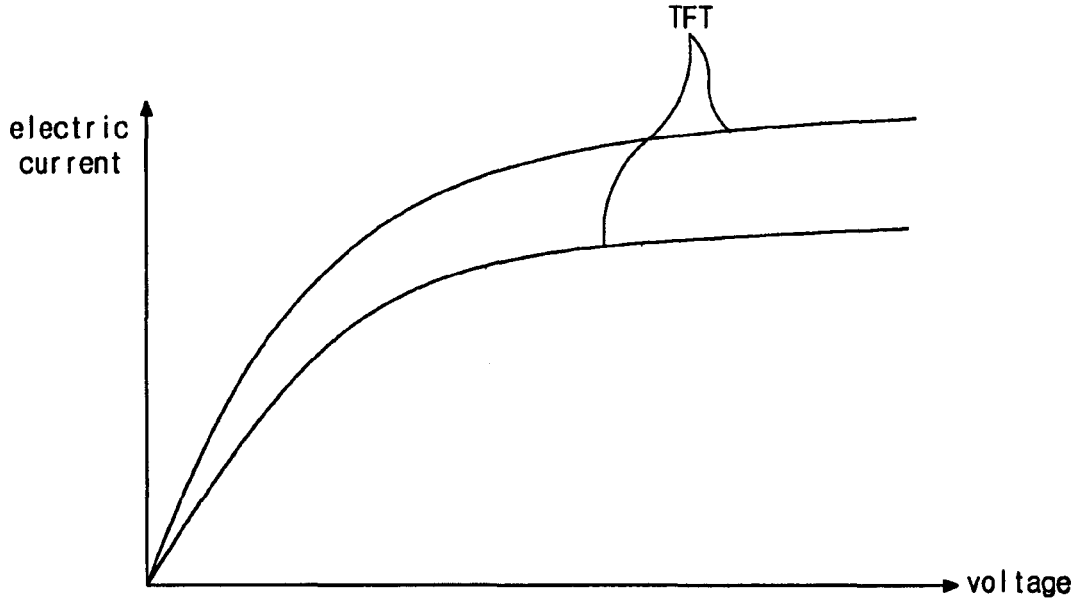
FIG. 3 RELATED ART
FIG. 3 is a graph showing deviation of an electric current on an organic electroluminescent diode with respect to a voltage on a driving TFT in the related art OELD.
Figure 4:
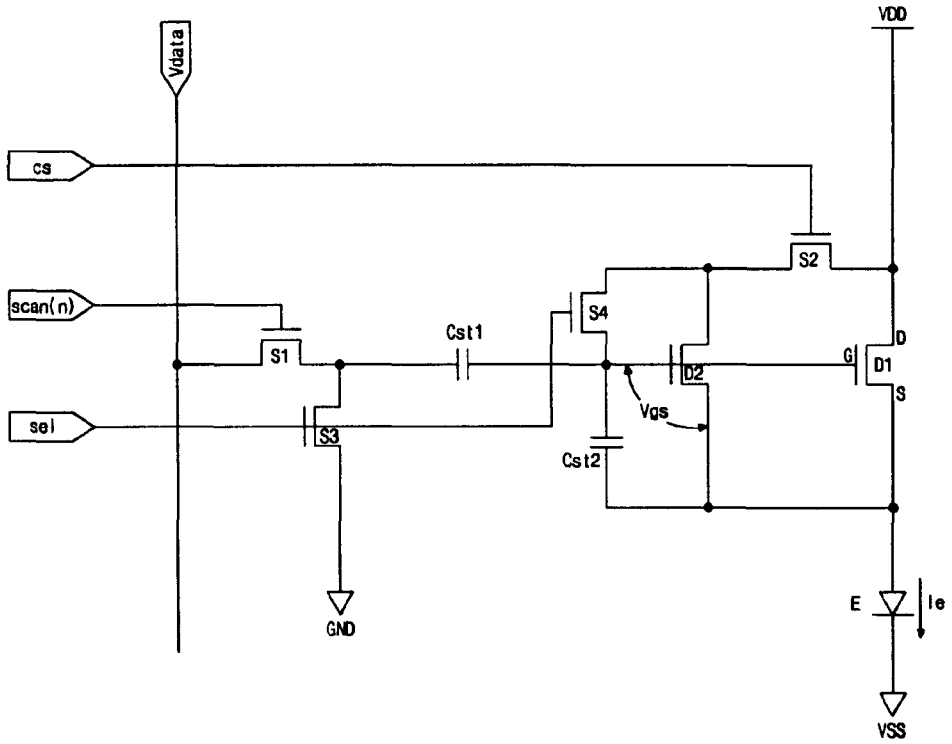
FIG. 4 is a circuit diagram showing a pixel of an OELD device according to a first embodiment of the present invention.

FIG. 4 is a circuit diagram showing a pixel of an OELD device according to a first embodiment of the present invention. In FIG. 4, an OELD includes an organic electroluminescent diode "E", first to fourth switching TFTs "S1", "S2", "S3" and "S4", first and second driving TFTs "D1" and "D2", and first and second capacitors "Cst1" and "Cst2" in each pixel. A channel of each of the first to fourth switching TFTs "S1" to "S4" and the first and second driving TFTs "D1" and "D2" may be an NMOS type. Depending on requirements, a channel of each of the first to fourth switching TFTs "S1" to "S4" and the first and second driving TFTs "D1" and "D2" may be a PMOS type.

The organic electroluminescent diode "E" is connected to a source terminal of the first driving TFT "D1" and a source terminal of the second driving TFT "D2" such that a driving electric current Ie is applied to the organic electroluminescent diode "E". The first and second driving TFTs "D1" and "D2" have the same properties and are electrically connected to each other in parallel. A driving voltage "VDD" is applied to a drain terminal of each of the first and second driving TFTs "D1" and "D2".

The first switching TFT "S1" receives a data voltage "Vdata" through a data line and an nth scan signal "scan(n)" through a scanning line. "n" is a positive integer. The first switching TFT "S1" is switched by the nth scan signal "scan(n)" and output the data voltage "Vdata".

The second switching TFT "S2" is disposed between a drain terminal of the first driving TFT "D1" and a drain terminal of the second driving TFT "D2". The second switching TFT "S2" is switched by a current providing signal "cs" for providing the driving voltage "VDD" to the second driving TFT "D2".

The third switching TFT "S3" receives a first ground voltage "GND" and is switched by a selection signal "sel" for providing the first ground voltage "GND" to an output terminal of the first driving TFT "S1". To reduce a number of signals, an (n−1)th scan signal may be used for the selection signal "sel". The first ground voltage "GND" may be used for a second ground voltage "VSS".

The fourth switching TFT "S4" is disposed among (connected to) an output terminal of the second switching TFT "S2", the gate terminal of the second driving TFT "D2" and the gate terminal of the first driving TFT "D1" and switched by the selection signal "sel".

The first capacitor "Cst1" is disposed among the output terminal of the first switching TFT "S1", the gate terminal of the first driving TFT "D1" and the gate terminal of the second driving TFT "D2", and the second capacitor "Cst2" is disposed between the source terminal of the second driving TFT "D2" and the gate terminal of the second driving TFT "D2". A parasitic capacitance generated between the gate terminal and the source terminal of the first driving TFT "D1" or between the gate terminal and the source terminal of the second driving TFT "D2" may be used as the second capacitor "Cst2". In this case, the second capacitor "Cst2" does not require forming a capacitor element.

Figure 5:
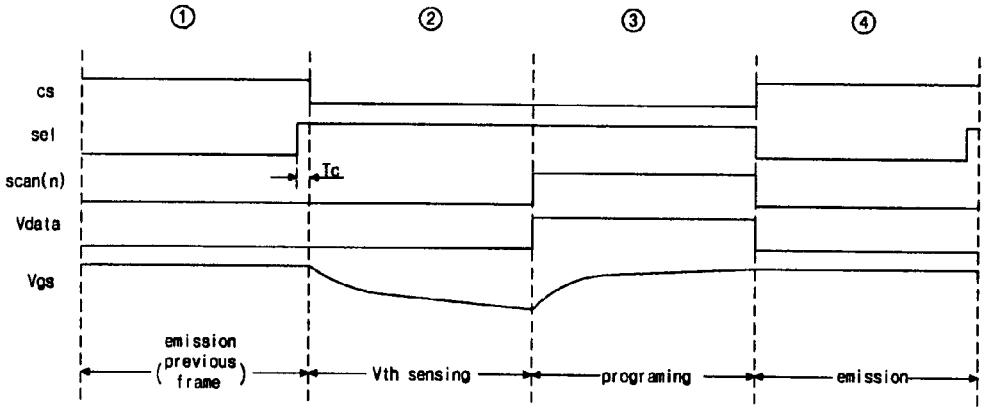
FIG. 5 is a timing chart for illustrating a driving principle of an OELD device according to the first embodiment of the present invention.

FIG. 5 is a timing chart for illustrating a driving principle of an OELD device according to the first embodiment of the present invention. FIG. 5 shows the selection signal "sel", the nth scan signal "scan(n)", the data voltage "Vdata", the voltage difference between the gate terminal and the source terminal of the second driving TFT "D2". There is an initializing interval "Tc" where the current providing signal "cs" and the selection signal "sel" are changed to be a high level in a first period "①" which is an emission step in a previous frame. Accordingly, in the initializing interval "Tc", each of the second to fourth switching TFTs "S2" to "S4" are turned on, and the driving voltage "VDD" is applied to the first capacitor "Cst1" and the second capacitor "Cst2". The driving voltage "VDD" applied during the initializing interval "Tc" is used for measuring the threshold voltage (Vth) of the second driving TFT "D2".

In a second period "②" for measuring (or sensing) the threshold voltage (Vth) of the second driving TFT "D2", the current providing signal "cs" is changed to be a low level, while the selection signal "sel" maintains as the high level. Accordingly, in the second period "②", the second switching TFT "S2" is turned off, while the third and fourth switching TFTs "S3" and "S4" maintain as the turned on state. In addition, the threshold voltage (Vth) of the second driving TFT "D2" is stored in each of the first and second capacitors "Cst1" and "Cst2".

Next, in a third period "③", the selection signal "sel" is changed to be a low level, while the nth scan signal "scan(n)" is changed to be a high level. Accordingly, the first switching TFT "S1" is turned on, while the second to fourth switching TFTs "S2" to "S4" are switched to be turned off. In addition, the data voltage "Vdata" passes through the first switching TFT "S1" such that the data voltage "Vdata" is charged in the second capacitor "Cst2" through the first capacitor "Cst1". As a result, the second capacitor "Cst2" has a state of (Vdata−GND+Vth). The voltage difference between the gate terminal and the source terminal of the second driving TFT "D2" (Vgs) is calculated by following equations.

$$Q=C*V,$$

$$Q1+Q2=Q(\text{total}),$$

$$C1*Vth+C2*(V\text{data}-\text{GND}+Vth)=(C1+C2)*Vgs.$$

Q1 is electric charge of the first capacitor "Cst1", and Q2 is electric charge of the second capacitor "Cst2". C1 is capacitance of the first capacitor "Cst1", and C2 is capacitance of the second capacitor "Cst2".

Accordingly, Vgs is represented by following equation 2.

$$Vgs=\{C2/(C1+C2)\}*(V\text{data}-\text{GND})+Vth \quad [2]$$

By the above equations 1 and 2, the driving electric current (Ie) is evaluated by following equation 3.

$$Ie=(½)*\mu*Cox*(W/L)*[\{C2/(C1+C2)\}*(V\text{data}-\text{GND})\}^2 \quad [3]$$

There is no threshold voltage (Vth) in the above equation 3. Namely, the threshold voltage (Vth) of the driving TFT has no effect to the driving electric current (Ie) for driving the organic electroluminescent diode. In the present invention, since deviation in an electric property of the first and second driving TFTs "D1" and "D2" during a fabricating process or a driving process, is minimized, a driving electric current (Ie) is uniformly applied to the organic electroluminescent diode.

In a third period "③", the first driving TFT "D1" is turned on by a voltage in the second capacitor "Cst2" such that an electric current is applied to the organic electroluminescent diode "E". In a fourth period "④", which is an emission period of a present frame, after the third period "③", the current providing signal "cs" only has a high level such that the second switching TFT "S2" is only switched to be turned on. Accordingly, the organic electroluminescent diode "E" in the fourth period "④" receives electric currents through the first and second driving TFTs "D1" and "D2", which are respectively turned on because of voltages in the first and second capacitors "Cst1" and "Cst2" such that light is emitted from the organic electroluminescent diode "E".

Figure 6:
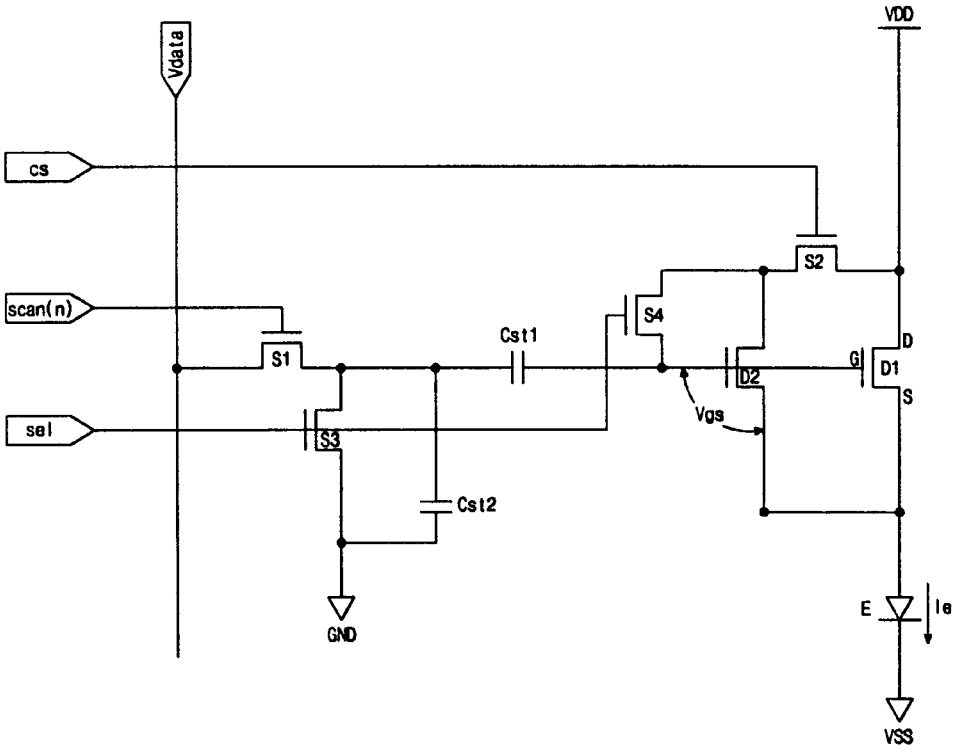
FIG. 6 is a circuit diagram showing a pixel of an OELD device according to a second embodiment of the present invention.

FIG. 6 is a circuit diagram showing a pixel of an OELD device according to a second embodiment of the present invention. With compared to the OELD device according to the first embodiment, the OELD device in FIG. 6 has the only difference in a position of a second capacitor "Cst2". In the second embodiment, to minimize an effect of a leakage current from each of first and third switching TFTs "S1" and "S3", the second capacitor "Cst2" is positioned between a source terminal of the third switching TFT "S3" and a drain terminal of the third switching TFT "S3".

A driving principle of the OELD device according to the second embodiment can be explained with reference to FIG. 5. With compared to a driving principle of the OELD device according to the first embodiment, a threshold voltage (Vth) of a second driving TFT "D2" is charged in a first capacitor "Cst1", not a second capacitor "Cst2" in a second period "②".

Figure 7:
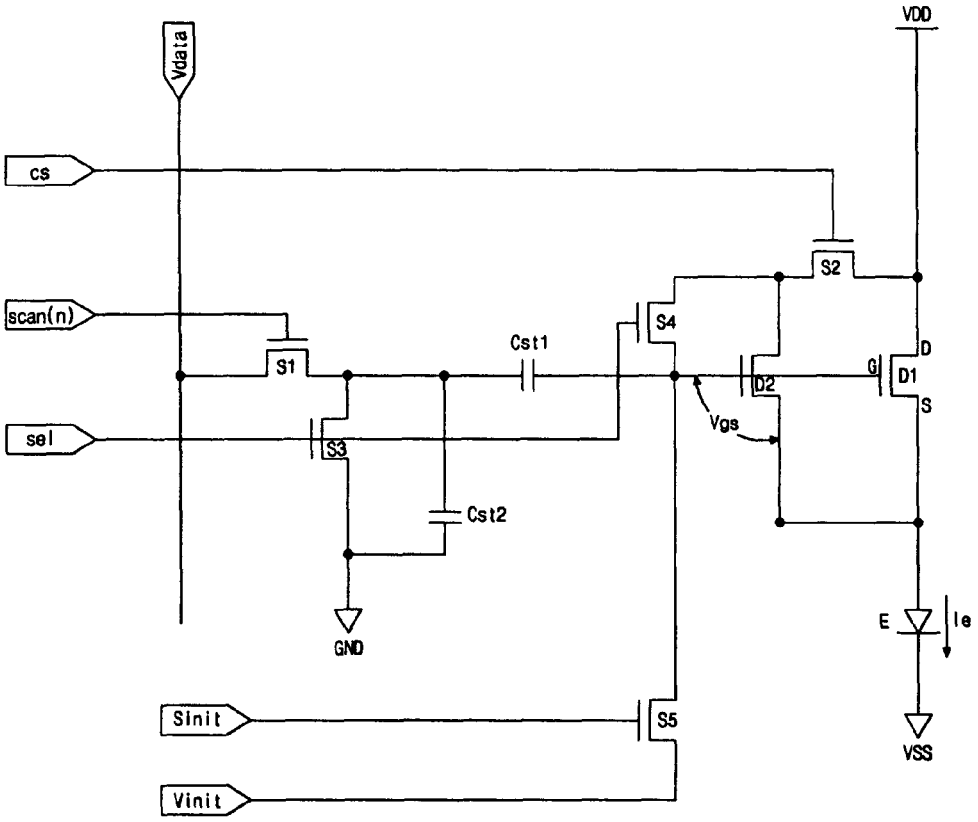
FIG. 7 is a circuit diagram showing a pixel of an OELD device according to a third embodiment of the present invention.

FIG. 7 is a circuit diagram showing a pixel of an OELD device according to a third embodiment of the present invention. Compared to the OELD device according to the second embodiment in FIG. 6, the OELD device according to the third embodiment in FIG. 7 further includes a fifth switching TFT "S5".

An initial voltage "Vinit" is applied to a source terminal of the fifth switching TFT "S5", and the fifth switching TFT "S5" is switched by an initializing signal "Sinit" to output the initial voltage "Vinit" into the gate terminal of each of the first and second driving TFTs "D1" and "D2".

The initial voltage "Vinit" is provided to compensate a fluctuating part of a threshold voltage which results from a change of an electric property of the first and second driving TFTs "D1" and "D2". The initial voltage "Vinit" is applied before a measuring step of the threshold voltage (Vth) such that a voltage difference "Vgs" between the gate terminal and the source terminal of the first driving TFT "D1" and the gate terminal and the source terminal of the second driving TFT "D2" becomes below 0 voltage. In other words, a curve of the threshold voltage's property is initialized by applying the initial voltage "Vinit".

Figure 8:
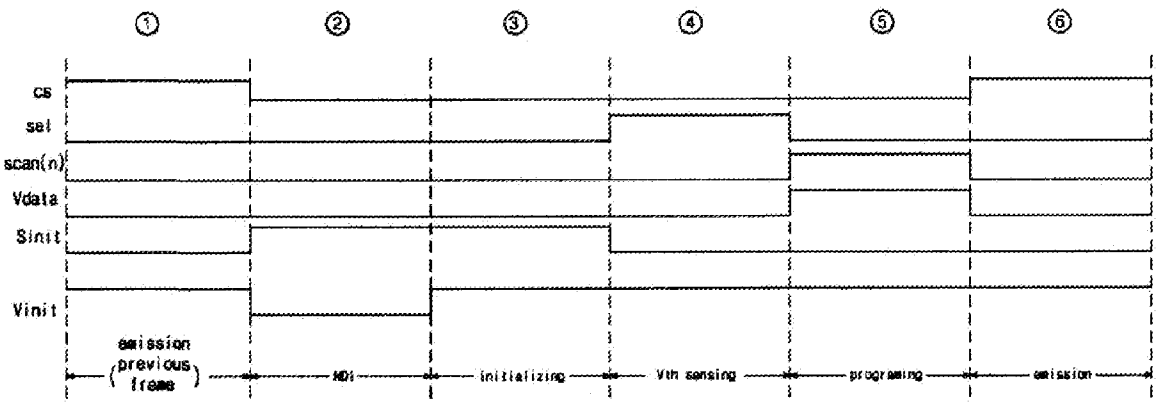
FIG. 8 is a timing chart for illustrating a first driving principle of an OELD device according to the third embodiment of the present invention.
Figure 9:
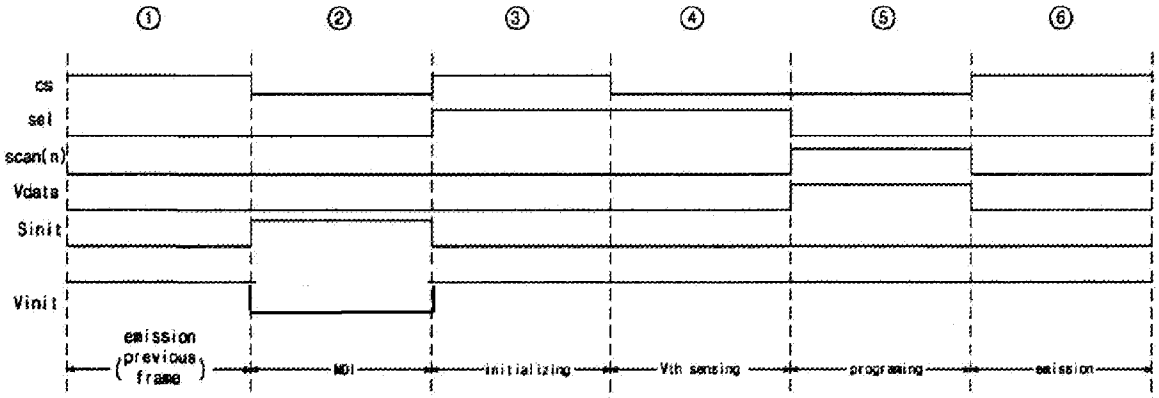
FIG. 9 is a timing chart for illustrating a second driving principle of an OELD device according to the third embodiment of the present invention.

FIG. 8 is a timing chart for illustrating a first driving principle of an OELD device according to the third embodiment of the present invention, and FIG. 9 is a timing chart for illustrating a second driving principle of an OELD device according to the third embodiment of the present invention. FIGS. 8 and 9 show a current providing signal "cs", a selection signal "sel", an nth scan signal "scan(n)", a data voltage "Vdata", an initializing signal "Sinit" and an initial voltage "Vinit".

Referring to FIG. 8, a negative voltage is provided in a second frame "②" after in a first period "①" which is an emission step in a previous frame. The second frame "②" may be referred to as a negative voltage applying step "NDI". The initializing signal "Sinit" is applied to be a high level, while the current providing signal "cs", the selection signal "sel" and the nth scan signal "scan(n)" are applied to be a low level. As a result, the fifth switching TFT "S5" will be switched to be turned on such that the initial voltage "Vinit" of the low level is applied to the gate terminal of the first and second driving TFTs "D1" and "D2" as described below. In this case, the initial voltage "Vinit" is negative such that the threshold voltage (Vth) of the first and second driving TFTs "D1" and "D2", which is changed during the previous frame, is initialized. When the first and second driving TFTs "D1" and "D2" are MMOS type, the initial voltage "Vinit" is equal to or smaller than a voltage of the source terminal of the first and second driving TFTs "D1" and "D2". Meanwhile, when the first and second driving TFTs "D1" and "D2" are PMOS type, the initial voltage "Vinit" is equal to or greater than a voltage of the source terminal of the first and second driving TFTs "D1" and "D2".

Next, in a third period "(3)" which is for initializing the threshold voltage (Vth) of the first and second driving TFTs "D1" and "D2", only the initializing signal "Sinit" has a high level such that the only fifth switching TFT "S5" has a turned on state. The initial voltage is shift to be a high level and applied to the gate terminal of the first and second driving TFTs "D1" and "D2". The initial voltage "Vinit" is applied for measuring the threshold voltage (Vth) of the second driving TFT "D2".

Next, in a fourth period "④" for measuring the threshold voltage (Vth) of the first and second driving TFTs "D1" and "D2", the initializing signal "Sinit" is changed to be a low level such that the fifth switching TFT "S5" is switched to be turned off. A driving principle from the fourth period "④" to a sixth period "⑥", which is an emission step, is same as a driving principle from the second period "②" to the fourth period "④" in FIG. 5. Accordingly, the explanation for these periods is omitted.

FIG. 9 is a timing chart for illustrating a second driving principle of an OELD device according to the third embodiment of the present invention. In FIG. 9, a negative voltage is provided in a second frame "②" after in a first period "①" which is an emission step in a previous frame. The second frame "②" may be referred to as a negative voltage applying step "NDI". The initializing signal "Sinit" is applied to be a high level, while the current providing signal "cs", the selection signal "sel" and the nth scan signal "scan(n)" are applied to be a low level.

As a result, the fifth switching TFT "S5" will be switched to be turned on such that the initial voltage "Vinit" of the low level is applied to the gate terminal of the first and second driving TFTs "D1" and "D2" as described below. In this case, the initial voltage "Vinit" is negative such that the threshold voltage (Vth) of the first and second driving TFTs "D1" and "D2", which is changed during the previous frame, is initialized.

Next, in a third period "③" which is for initializing the threshold voltage (Vth) of the first and second driving TFTs "D1" and "D2", the current providing signal "cs" and the selection signal "sel" are provided as a high level, while other signals, for example, the nth scan signal "scan(n)" and the initializing signal "Sinit", are provided as a low level. Accordingly, the second to fourth switching TFTs "S2" to "S4" are switched to be turned on, while the first and fifth switching TFTs "S1" and "S5" are switched to be turned off. As a result, a driving voltage "VDD" is applied to the first and second capacitor "Cst1" and "Cst2" for measuring (or sensing) a threshold voltage of the second driving TFT "D2".

A driving principle from the fourth period "④" to a sixth period "⑥", which is an emission step, is same as a driving principle from the second period "②" to the fourth period "④" in FIG. 5. Accordingly, the explanation for these periods is omitted.

In the OELD device according to the third embodiment, an effect of the threshold voltage of the driving TFT on a driving electric current (Ie) is excluded such that deviation of an electric property of the first and second driving TFTs in the OELD device resulting from the threshold voltage is improved. In addition, since the voltage difference "Vgs" between the gate terminal and the source terminal of each of the first and second driving TFTs becomes a negative voltage (below 0 voltage) by applying the initial voltage "Vinit" to the first and second driving TFTs before a Vth sensing step, a fluctuating part in the threshold voltage of the first and second driving TFTs is compensated before the Vth sensing step. Accordingly, deviation of an electric property of the first and second driving TFTs in the OELD device during a driving process is minimized.

Figure 10:
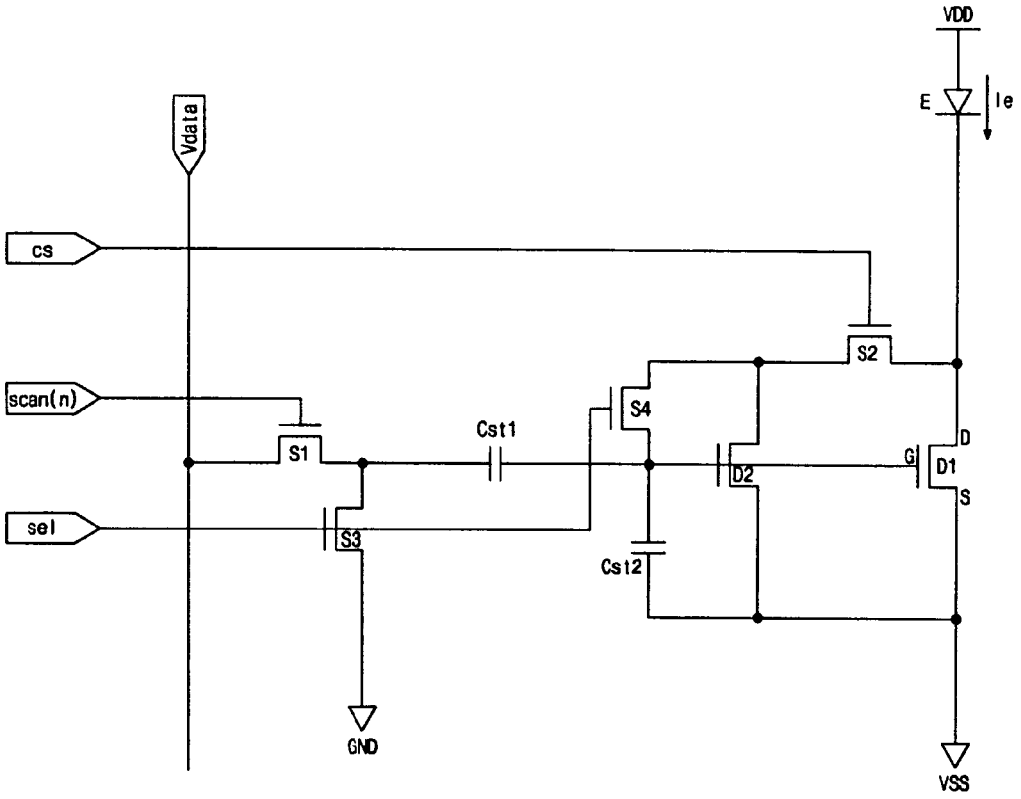
FIG. 10 is a circuit diagram showing a pixel of an OELD device according to a fourth embodiment of the present invention.
Figure 11:
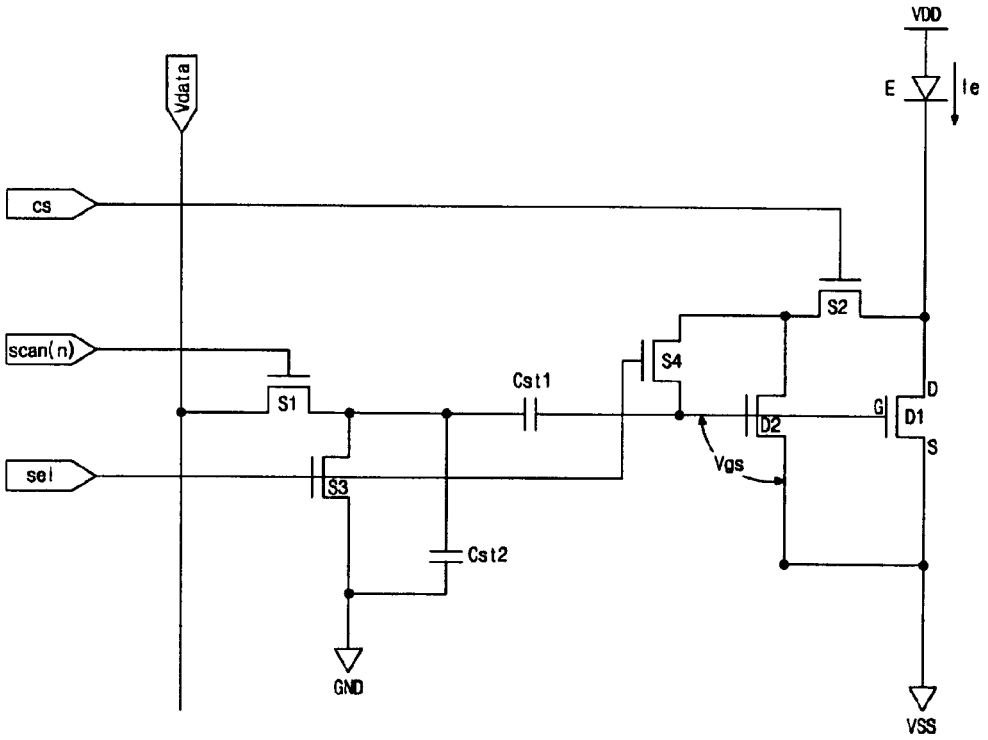
FIG. 11 is a circuit diagram showing a pixel of an OELD device according to a fifth embodiment of the present invention.
Figure 12:
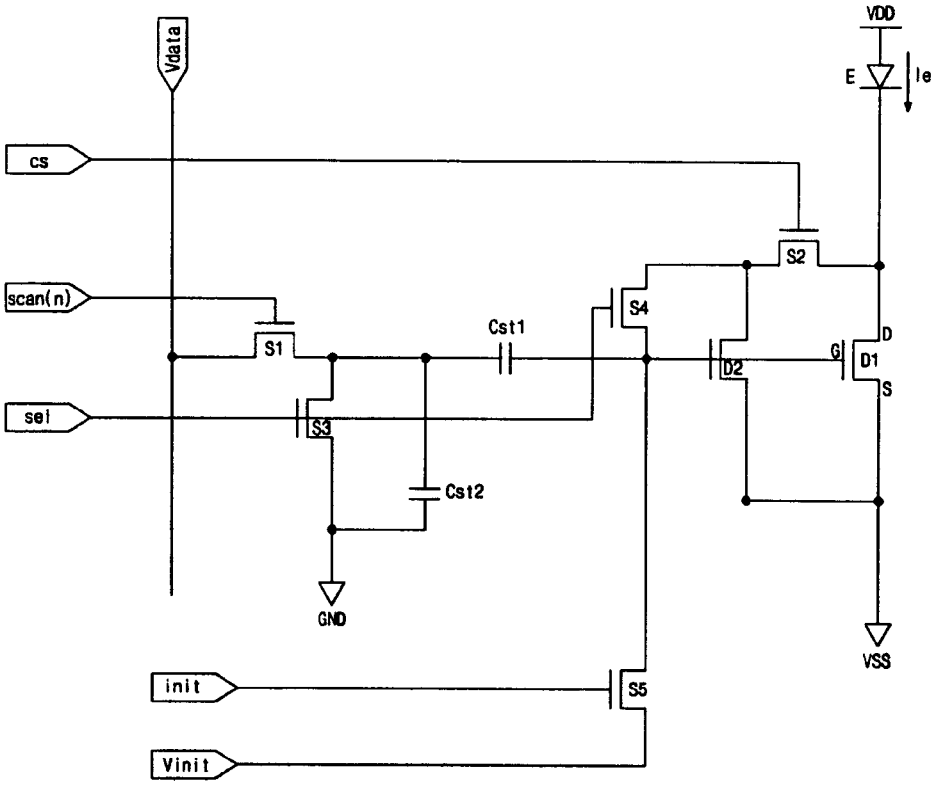
FIG. 12 is a circuit diagram showing a pixel of an OELD device according to a sixth embodiment of the present invention.

FIG. 10 is a circuit diagram showing a pixel of an OELD device according to a fourth embodiment of the present invention, FIG. 11 is a circuit diagram showing a pixel of an OELD device according to a fifth embodiment of the present invention, and FIG. 12 is a circuit diagram showing a pixel of an OELD device according to a sixth embodiment of the present invention. With respectively compared to the OELD device according to the first to third embodiments, there is a difference in a position of an organic electroluminescent diode "E" in the OELD device according to the fourth to sixth embodiments.

In more detail, the organic electroluminescent diode "E" is disposed between the driving voltage "VDD" and the drain terminal "D" of the first driving TFT "D1" such that the driving voltage "VDD" is applied to an anode of the organic electroluminescent diode "E". Other driving principles are substantially same as the driving principles of the OELD device according to the first to third embodiments.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An organic electroluminescent display device, comprising:

an organic electroluminescent diode receiving a driving voltage and a first ground voltage;

a first driving thin film transistor and a second driving thin film transistor for driving a current to the organic electroluminescent diode, the first driving thin film transistor directly connected to the driving voltage and a second switching thin film transistor, and each of the first and the second driving thin film transistors receiving one of the driving voltage and the first ground voltage;

a first switching thin film transistor receiving a data voltage and switched by an nth scan signal to output the data voltage;

the second switching thin film transistor switched by a current providing signal to switch one of the driving voltage and the first ground voltage to the second driving thin film transistor;

a third switching thin film transistor receiving a second ground voltage and switched by a selection signal to output the second ground voltage to an output terminal of the first switching thin film transistor;

a fourth switching thin film transistor connected to an output terminal of the second switching thin film transistor, a gate terminal of the first driving thin film transistor, and a gate terminal of the second driving thin film transistor, and switched by the selection signal;

a first capacitor connected to the output terminal of the first switching thin film transistor, the gate terminal of the first driving thin film transistor, and the gate terminal of the second driving thin film transistor;

a second capacitor connected to a source terminal of the third switching thin film transistor and a drain terminal of the third switching thin film transistor; and an initial voltage at a first level to initialize the first and the second driving thin-film transistors and shifted to a second level for measuring a threshold voltage of the second driving thin-film transistor;

a fifth switching thin film transistor for receiving the initial voltage and switched by an initializing signal to output the initial voltage into the gate terminal of the first driving thin film transistor and the gate terminal of the second driving thin film transistor, wherein "n" is a positive integer, wherein a drain terminal of the fifth switching thin film transistor is connected to the second electrode of the first capacitor, a drain terminal of the fourth switching thin film transistor, the gate terminal of the first driving thin film transistor, and the gate terminal of the second driving thin film transistor; and wherein one electrode of the second capacitor is commonly connected to the output terminal of the first switching thin film transistor and the first electrode of the first capacitor, and another electrode of the second capacitor receives the ground voltage.

2. The device according to claim 1, wherein each of the first to the fifth switching thin film transistors and the first and the second driving thin film transistors is an NMOS type or a PMOS type.

3. The device according to claim 2, wherein the initial voltage is equal to or less than a voltage of a source terminal of the first and the second driving thin film transistors when each of the first to the fifth switching thin film transistors and the first and the second driving thin film transistors is an NMOS type, and wherein the initial voltage is equal to or greater than a voltage of a source terminal of the first and the second driving thin film transistors when each of the first to the fifth switching thin film transistors and the first and the second driving thin film transistors is a PMOS type.

4. The device according to claim 1, wherein the fifth switching thin film transistor is directly connected to the second driving thin film transistor and the fourth switching thin film transistor.

5. A method of driving an organic electroluminescent display device including an organic electroluminescent diode receiving a driving voltage and a first ground voltage, a first driving thin film transistor and a second driving thin film transistor for driving a current to the organic electroluminescent diode, each of the first and the second driving thin film transistors receiving one of the driving voltage and the first ground voltage, a first switching thin film transistor receiving a data voltage and switched by an nth scan signal to output the data voltage, a second switching thin film transistor switched by a current providing signal to provide the one of the driving voltage and the first ground voltage to the second driving thin film transistor, a third switching thin film transistor receiving a second ground voltage and switched by a selection signal to output the second ground voltage to an output terminal of the first switching thin film transistor, a fourth switching thin film transistor connected to an output terminal of the second switching thin film transistor, a gate terminal of the first driving thin film transistor and a gate terminal of the second driving thin film transistor and switched by the selection signal, a fifth switching thin film transistor receiving an initial voltage and switched by an initializing signal to output the initial voltage into the gate terminal of the first driving thin film transistor and the gate terminal of the second driving thin film transistor, a first capacitor connected to the output terminal of the first switching thin film transistor, the gate terminal of the first driving thin film transistor and the gate terminal of the second driving thin film transistor, a second capacitor connected to a source terminal of the third switching thin film transistor and the drain terminal of the third switching thin film transistor, wherein "n" is a positive integer, wherein a drain terminal of the fifth switching thin film transistor is connected to the second electrode of the first capacitor, a drain terminal of the fourth switching thin film transistor, the gate terminal of the first driving thin film transistor and the gate terminal of the second driving thin film transistor, and wherein one electrode of the second capacitor is commonly connected to the output terminal of the first switching thin film transistor and the first electrode of the first capacitor and another electrode of the second capacitor receives the ground voltage, comprising:

during a negative voltage applying step, switching on the fifth switching thin film transistor such that the initial voltage of a low level is provided into the gate terminal of the first and the second driving thin film transistors;

during an initializing step, switching off the second to the fourth switching thin film transistors and providing the initial voltage of a high level into the gate terminal of the first and the second driving thin film transistors with the fifth switching thin film transistor turned on;

during a sensing step, switching on the third and the fourth switching thin film transistor and switching off the first and the second switching thin film transistors such that a threshold voltage of the second driving thin film transistor is charged in each of the first and the second capacitors;

during a programming step, switching on the first switching thin film transistor and providing the data voltage into the second capacitor through the first switching thin film transistor, wherein the third and the fourth switching thin film transistors are switched off; and during an emission step, switching on the second switching thin film and switching off the first switching thin film transistor such that the organic electroluminescent diode emits a light using the driving voltage and the first ground voltage.

6. A method of driving an organic electroluminescent display device including an organic electroluminescent diode receiving a driving voltage and a first ground voltage, a first driving thin film transistor and a second driving thin film transistor for driving a current to the organic electroluminescent diode, the first driving thin film transistor directly connected to the driving voltage and a second switching thin film transistor, and each of the first and the second driving thin film transistors receiving one of the driving voltage and the first ground voltage, a first switching thin film transistor receiving a data voltage and switched by an nth scan signal to output the data voltage, the second switching thin film transistor switched by a current providing signal to switch one of the driving voltage and the first ground voltage to the second driving thin film transistor, a third switching thin film transistor receiving a second ground voltage and switched by a selection signal to output the second ground voltage to an output terminal of the first switching thin film transistor, a fourth switching thin film transistor connected to an output terminal of the second switching thin film transistor, a gate terminal of the first driving thin film transistor and a gate terminal of the second driving thin film transistor and switched by the selection signal, a fifth switching thin film transistor receiving an initial voltage and switched by an initializing signal to output the initial voltage into the gate terminal of the first driving thin film transistor and the gate terminal of the second driving thin film transistor, a first capacitor connected to the output terminal of the first switching thin film transistor, the gate terminal of the first driving thin film transistor and the gate terminal of the second driving thin film transistor, a second capacitor connected to a source terminal of the third switching thin film transistor and the drain terminal of the third switching thin film transistor, wherein "n" is a positive integer, wherein a drain terminal of the fifth switching thin film transistor is connected to the second electrode of the first capacitor, a drain terminal of the fourth switching thin film transistor, the gate terminal of the first driving thin film transistor and the gate terminal of the second driving thin film transistor, and wherein one electrode of the second capacitor is commonly connected to the output terminal of the first switching thin film transistor and the first electrode of the first capacitor and another electrode of the second capacitor receives the ground voltage, comprising:

during a voltage applying step, switching on the fifth switching thin film transistor such that the initial voltage at a first level is provided into the gate terminal of the first and the second driving thin film transistors to initialize the first and the second driving thin film transistors;

during an initializing step, switching on the second to the fourth switching thin film transistors, switching off the first and the fifth switching thin film transistors, and shifting the initial voltage to a second level such that the driving voltage is provided into the first and the second capacitors to initialize the first and the second driving thin film transistors;

during a sensing step, switching on the third and the fourth switching thin film transistors and switching off the first, the second, and the fifth switching thin film transistors such that a threshold voltage of the second driving thin film transistor is charged in each of the first and the second capacitors for measuring the threshold voltage of the second driving thin-film transistor;

during a programming step, switching on the first switching thin film transistor and providing the data voltage into the second capacitor through the first switching thin film transistor, wherein the third and the fourth switching thin film transistors are switched off; and during an emission step, switching on the second switching thin film transistor and switching off the first switching thin film transistor such that the organic electroluminescent diode emits a light using the driving voltage and the first ground voltage.

7. The method according to claim 6, wherein the fifth switching thin film transistor is directly connected to the second driving thin film transistor and the fourth switching thin film transistor.

* * * * *